United States Patent [19]

Spellman

[11] Patent Number: 4,531,258

[45] Date of Patent: Jul. 30, 1985

[54] REFUSE BAG FRAME FOR VACUUM CLEANERS

[76] Inventor: Stanley Spellman, 75 Cedar Dr., Roslyn, N.Y. 11576

[21] Appl. No.: 613,076

[22] Filed: May 22, 1984

[51] Int. Cl.[3] ..... A47L 5/00

[52] U.S. Cl. ..... 15/327 R; 55/429; 55/DIG. 3; 55/379; 248/97; 248/99

[58] Field of Search ..... 55/379–381, 55/429, 492, DIG. 2, DIG. 3; 248/97, 99; 15/327 R

[56] References Cited

U.S. PATENT DOCUMENTS

| | | | |
|---|---|---|---|
| 2,643,732 | 6/1953 | Keen | 55/379 |
| 2,814,357 | 11/1957 | Bowman | 55/379 |
| 3,222,019 | 12/1965 | Weisberg | 248/97 |
| 3,568,413 | 3/1971 | Jerabek | 55/379 |
| 3,598,350 | 8/1971 | Kaufman | 248/97 |
| 3,740,933 | 6/1973 | Hollowell | 55/429 |
| 4,413,800 | 11/1983 | Kelson | 248/99 |

FOREIGN PATENT DOCUMENTS

| | | | |
|---|---|---|---|
| 2759220 | 1/1979 | Fed. Rep. of Germany | 55/379 |
| 0007287 | 2/1980 | Japan | 55/379 |

*Primary Examiner*—Charles Hart

*Attorney, Agent, or Firm*—Collard, Roe & Galgano

[57] ABSTRACT

A refuse bag frame for supporting a refuse bag in a vacuum cleaner is provided. The vacuum cleaner has a cylindrical bin lined by the refuse bag and a cover thereover including a vacuum blower and a collection inlet, the rim of the open end of the refuse bag is clamped between the rim of the cylindrical bin and the cover. The refuse bag frame includes at least one hoop having a diameter no greater than the internal diameter of the cylindrical bin and a plurality of spaced-apart, rigid, vertical supports connected to said at least one hoop and having lengths no greater than the internal height of said cylindrical bin, the vertical supports being connected to the at least one hoop so as to form a cylindrically-shaped frame dimensioned to fit within the refuse bag lining the cylindrical bin of the vacuum cleaner. The at least one hoop may be formed from a severable, flexible strip and the supports formed from severable, rigid elongated strips which are cut to the appropriate dimensions of the cylindrical bin and fastened together as necessary.

21 Claims, 10 Drawing Figures

REFUSE BAG FRAME FOR VACUUM CLEANERS

The present invention relates to a refuse bag frame for vacuum cleaners.

Vacuum trash collectors or vacuum cleaners, particularly of the industrial type, generally have a cylindrical bin to which is connected a pick-up hose and a vacuum blower and which is mounted on wheels or rollers for movement. The vacuum blower evacuates the cylindrical bin and the vacuum is directed through the pick-up hose so that the user is able to vacuum with the hose. Whatever debris is picked up by the pick-up hose by the user is deposited in the cylindrical bin of the vacuum cleaner. Periodically, when the cylindrical bin is full, it must be emptied. This emptying of the vacuum cleaner bin can be a very messy operation since the bin must be physically lifted and inverted in order to dump the contents. During dumping, care must be exercised in order not to spill the contents. In addition, this operation very often is cumbersome because of the size and weight of the vacuum cleaner.

It has been proposed to utilize a plastic bag which is inserted in the vacuum cleaner bin with the rim of the open end thereof being clamped between the rim of the cylindrical bin and the vacuum cleaner cover. In this manner the debris is collected in the plastic bag which is merely lifted from the bin when full and discarded. However, the vacuum created in the cylindrical bin by the vacuum blower will tend to cause the plastic bag to collapse and be drawn against the vacuum blower thus blocking flow and preventing proper operation. In U.S. Pat. No. 3,740,933, to Hollowell, granted June 26, 1973, it is proposed to install a rigid cylindrical liner inside the plastic bag so as to support the plastic bag when it is subjected to the vacuum of the vacuum blower. According to the Hollowell patent, the rigid cylindrically shaped liner is withdrawn or slipped out of the bag when the latter has been filled so that the bag may be closed and disposed of. Although such a cylindrically-shaped, rigid liner performs adequately when utilized in combination with a plastic bag installed within a vacuum cleaner, it is somewhat unwieldy and, therefore, leads to problems in its transportation and sale. Since such liners, when sold separate and apart from the vacuum cleaners with which they are used, are merely empty cylinders, they take up an unwarranted amount of space during transportation from the manufacturer to the point of sale, while on display by the seller and during storage by the seller or consumer. Also, the cylindrically shaped liner of the Hollowell patent cannot be utilized with a vacuum cleaner which has its collection inlet and pick-up hose located in the sidewall of the collection bin.

In addition, since such cylindrically-shaped liners must be manufactured so that each one fits a particular size of vacuum cleaner bin it is necessary that there be a number of various sized cylindrical liners produced matching the number of vacuum cleaners available on the market. This factor additionally adds to the transportation, storage and display problems already noted.

It is, therefore, a primary object of the present invention to provide a frame for a refuse bag utilized in connection with a vacuum cleaner having a cylindrical bin wherein the collection inlet and pick-up hose are located either in the vacuum cleaner cover or in the sidewall of the cylindrical bin. Also, such a refuse bag frame may be transported, stored and displayed in a collapsed condition and erected by the user and the size adjusted to the requirements of the particular vacuum cleaner.

The above objects, as well as others which will hereinafter become apparent, are accomplished in accordance with the present invention by the provision of a frame for the refuse bag of a vacuum cleaner which is comprised of a plurality of vertically spaced-apart hoops interconnected by a plurality of rigid, vertical supports which basically corresponds to the shape of the cylindrical bin within which the refuse bag is utilized. The refuse bag frame may include a plurality of rigid, elongated supports having a length great enough to accommodate a wide range of depths of different sized vacuum cleaners and a plurality of elongated flexible strips having lengths sufficient to form hoops to accommodate the diameters of this range of vacuum cleaners. The lengths of the elongated flexible strips may then be adjusted and formed by the user into hoops of the required diameter and connected in a vertically spaced-apart relationship by suitable fasteners to the elongated, rigid supports, the lengths of which may be easily adjusted by cutting to the required depth of the vacuum cleaner. Thus, it is possible for the refuse bag frame to be a fixed unitary structure or an erectable one or one that is adjustable in size.

In another embodiment, the rigid supports may be in the form of angles, the lengths of the legs of which may be adjusted so that one leg of each support may be interconnected at its end to corresponding legs of the other supports in such a manner that the legs radiate from a central connection point thereby forming a base for the frame having a diameter corresponding to the diameter of the vacuum cleaner. The vertical supports, disposed circumferentially and corresponding to the diameter of the cylindrical bin of the vacuum cleaner, are interconnected by a hoop or hoops formed from elongated flexible strips.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
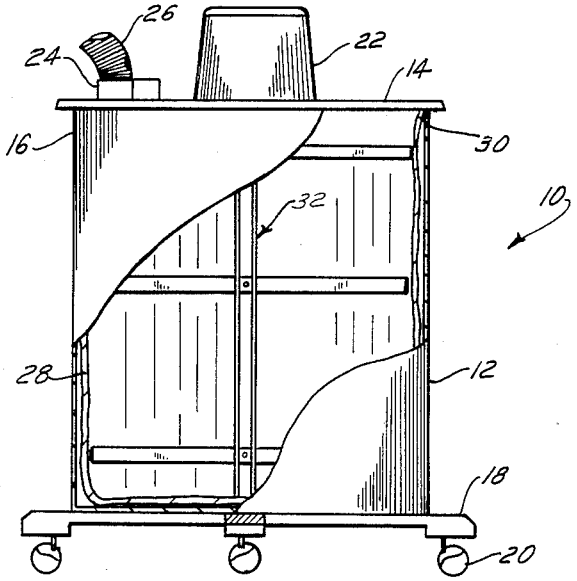
FIG. 1 is an elevational view of a vacuum cleaner, a part thereof being broken away, incorporating the present invention.

Referring now to the drawings, there is shown in FIG. 1 a vacuum cleaner, generally designated 10, having a cylindrically shaped bin, designated 12, covered by a removable cover 14 secured to the upper rim 16 of cylindrical bin 12. Cylindrical bin 12 may be supported on platform 18 which in turn rests on casters 20. Vacuum cleaner cover 14 supports a vacuum blower (not shown) in motor housing 22 and includes a collection inlet 24 to which vacuum hose 26 is connected.

For the purpose of collecting the debris which enters cylindrical bin 12 via vacuum hose 26, a flexible bag, generally designated 28, is disposed in cylindrical bin 12 with its open upper rim or edge clamped between the upper rim 16 of cylindrical bin 12 and cover 14. Preferably, refuse bag 28 is formed of an impervious material such as plastic so that whatever debris is collected therein remains in the bag and is not transmitted to the interior of cylindrical bin 12. As pointed out above, without a support for refuse bag 28 in cylindrical bin 12, the bag would collapse as a result of the vacuum produced by the vacuum blower and thereby disrupt the operation of the vacuum cleaner. Thus, a refuse bag frame, generally designated 32, is provided inside of refuse bag 28 in order to maintain the bag's shape substantially lining the interior of cylindrical bin 12.

Figure 2:
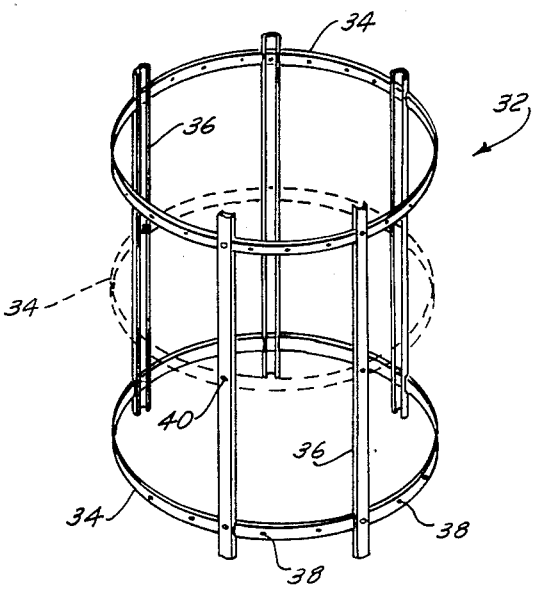
FIG. 2 is a perspective view of the refuse bag frame of the present invention.

As clearly seen in FIG. 2, frame 32 is comprised of a plurality of vertically spaced-apart hoops, generally designated 34, which are interconnected by spaced-apart, rigid, vertical supports, designated 36. Although frame 32 may be formed as a unitary structure, it is also possible to construct frame 32 from its individual components. Thus, each hoop 34 may be formed from an elongated, flexible strip the ends of which are brought together into a loop corresponding to the circumferential dimension of the interior of cylindrical bin 12 and the ends fastened together in any suitable manner. In addition, the flexible strip can be sufficiently long to accommodate the largest size of vacuum cleaner intended and the length adjusted by cutting to accommodate smaller vacuum cleaners. Preferably, the material of hoops 34 is flexible and is provided with sufficient strength to prevent the collapse of the sidewalls of refuse bag 28. It may also be easily severed or cut by means of shears or a knife for purposes of adjustability. Thus, the material can be very thin plastic, wood or metal.

Figure 3:
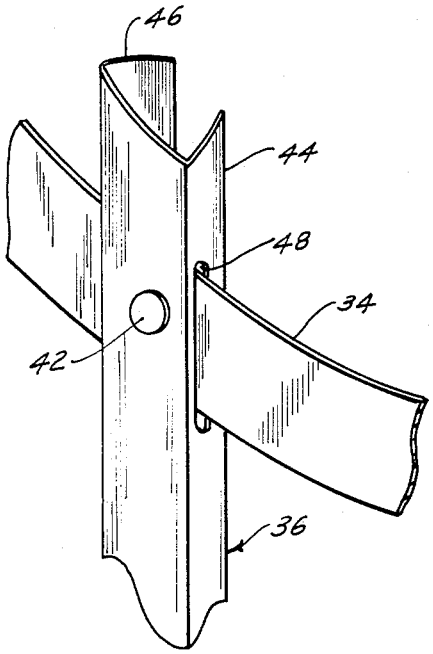
FIG. 3 is an enlarged perspective view of a portion of the refuse bag frame of FIG. 2.
Figure 6:
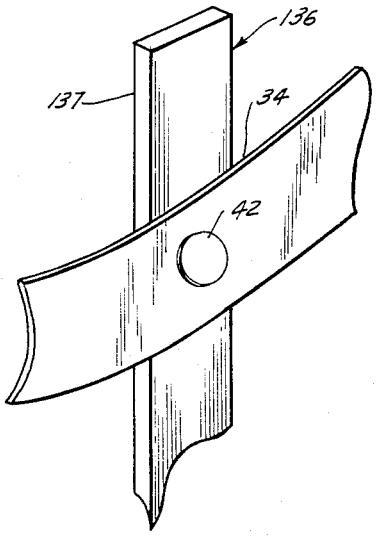
FIG. 6 is an enlarged perspective view of a portion of the refuse bag frame of either FIG. 4 or FIG. 5.
Figure 7:
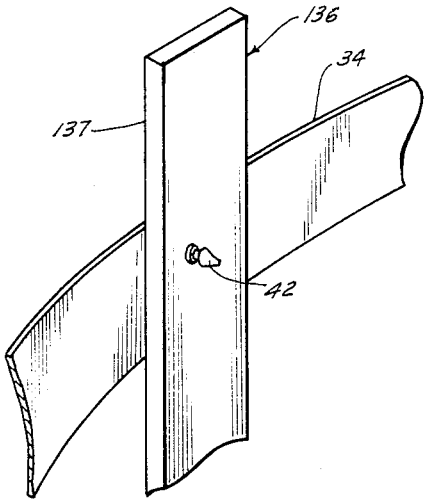
FIG. 7 is an enlarged perspective view similar to that of FIG. 6 but viewed from the other direction thereof.

Rigid supports 36 likewise are formed from elongated, rigid strips and may be easily severed so that the height of frame 32 may be adjusted for the height of the cylindrical bin of the particular vacuum cleaner with which the frame is to be used. Advantageously, a plurality of apertures, designated 38, are provided in hoops 34 and a plurality of apertures, designated 40, are provided in rigid supports 36. Suitable fastening devices, such as nuts and bolts, rivets and preferably plastic, push-type fasteners, designated 42, are utilized for connecting the ends of each hoop 34 together and for connecting hoops 34 to vertically extending, rigid supports 36, as clearly seen in FIGS. 3, 6 and 7. For the purpose of lending rigidity to supports 36, they may be constructed of a relatively thin metal or plastic material in the form of a channel having flanges 44 and 46. Flanges 44 and 46 may be provided with a plurality of paired slots, designated 48, each slot of a pair being aligned with the other so as to permit the strip which forms hoop 34 to be threaded through flanges 44 and 46 of each support 36. Apertures 40 in supports 36 are aligned with slots 48 so that a fastening device 42 secures hoop 34 to support 36, as clearly seen in FIG. 3.

Figure 4:
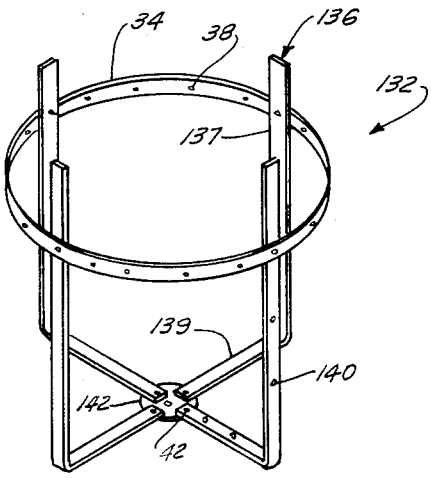
FIG. 4 is another embodiment of the refuse bag frame of the present invention.

In FIG. 4, there is shown another embodiment of the refuse bag frame of the present invention, which is designated 132, and shows a single hoop 34 interconnecting a plurality of spaced-apart, vertically extending, rigid supports 136. Each support 136 is substantially L-shaped having a vertical leg 137 and a horizontal base leg 139. The end of each horizontal base leg 139 is attached to a disk-shaped base plate, designated 142, by suitable means such as fasteners 42. Supports 136 are formed of relatively thick material in order to lend rigidity thereto. Nevertheless, supports 136 should not be so thick or strong that they cannot be cut so that the lengths of legs 137 and 139 can be adjusted by cutting or severing to accommodate the diameter and height of the vacuum cleaner in which they are utilized. A plurality of apertures 140 are provided in legs 137 and 139 of support 136 for attachment thereof to base plate 142 and hoop 34.

Figure 5:
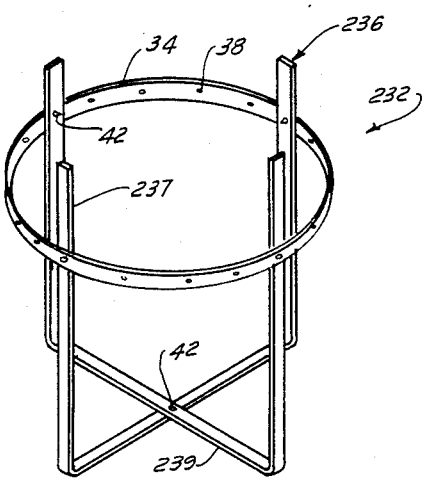
FIG. 5 is a perspective view of yet another embodiment of the refuse bag frame according to the present invention.

Another embodiment of the refuse bag frame, designated 232, is shown in FIG. 5. This embodiment is substantially similar to the embodiment shown in FIG. 4 except that instead of L-shaped supports 136, supports 236 are U-shaped having two vertical legs 237 connected by a horizontal base leg 239. At least two such supports are utilized in frame 232 and are joined by suitable means such as fastener 42 at the center points of base legs 239. In the same manner as the earlier embodiments, hoop 34 is fastened to spaced-apart legs 237 of supports 236 by means of fasteners 42.

Figure 9:
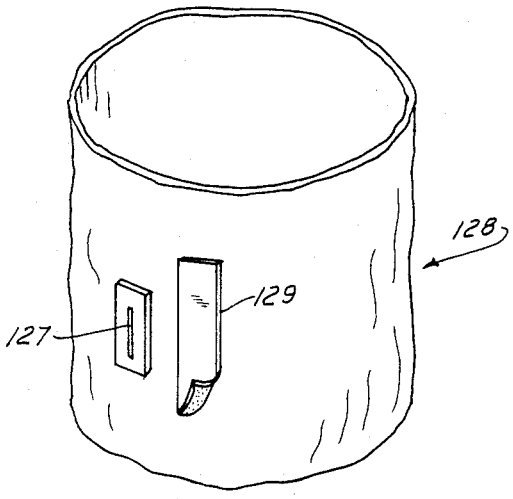
FIG. 9 is a perspective view of the refuse bag utilized in the vacuum cleaner of FIG. 8.
Figure 10:
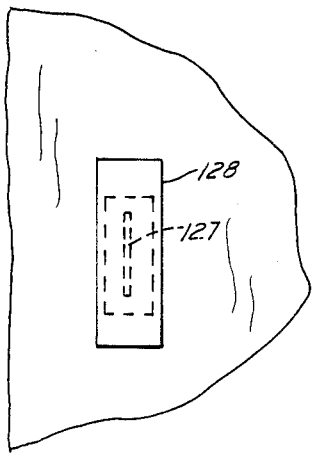
FIG. 10 is an enlarged elevational view of a segment of the refuse bag of FIG. 9.
Figure 8:
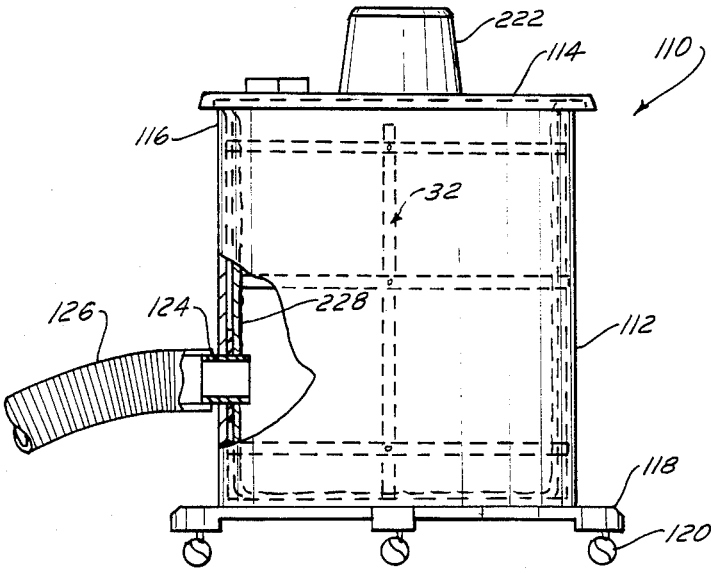
FIG. 8 is an elevational view of another type of vacuum cleaner incorporating the present invention, a part thereof being broken away.

FIGS. 8 to 10 demonstrate the use of the refuse bag frame according to the present invention with a type of vacuum cleaner in which the pick-up extends from the side of the vacuum cleaner rather than from its top, as clearly seen in FIG. 1. Thus, in FIG. 8 there is shown a vacuum cleaner, designated 110, which is in all respects the same as the vacuum cleaner 10 of FIG. 1 except that collection inlet 124 and vacuum hose 126 enter at the sidewall of cylindrical bin, 112. Collection inlet 124 extends into cylindrical bin 112 and into refuse bag 128 via an opening therein, designated 127, which is preferably adapted to seal around hose connection 124. As clearly seen in FIG. 8, refuse bag frame 32 maintains the shape of bag 128 without interfering with the intake into the bag from vacuum hose 126. Means must be provided for such a refuse bag to insure that the collected debris does not inadvertently spill out when the filled bag is removed from the vacuum cleaner and discarded. One means of accomplishing this is shown in FIGS. 9 and 10 wherein a removable tape 129 may be included with bag 128 for the purpose of sealing opening 127 upon the removal of bag 128 from vacuum cleaner 110.

It is to be appreciated that with each of the embodiments described above, when the refuse bag has become full and it is desired to discard the same, it is a simple matter to remove the refuse bag frame from the refuse bag by lifting it therefrom and then discarding the filled refuse bag. In this manner, it is possible to continue reusing the refuse bag frame as desired. It should furthermore be noted that although each embodiment described above relates to an erectable refuse bag frame, each such embodiment may also be provided in a unitary structure.

While only a few embodiments of the present invention have been shown and described, it will be obvious that many changes and modifications may be made thereto without departing from the spirit and scope of the present invention.

What is claimed is:

1. A refuse bag frame for supporting a refuse bag in a vacuum cleaner, said vacuum cleaner having a cylindrical bin lined by said refuse bag and a cover for the cylindrical bin including a vacuum blower and collection inlet, the rim of the open end of the refuse bag being clamped between the rim of the cylindrical bin and the cover, said refuse bag frame comprising:

(a) at least one hoop having a diameter no greater than the internal diameter of said cylindrical bin;

(b) a plurality of spaced apart, rigid, vertical supports, each support having a length no greater than the internal length of said cylindrical bin and having a channel-like cross-sectional configuration with opposing flanges and pairs of aligned vertical slots, each slot of a pair being formed in a flange opposite the other slot and adapted to receive said hoop therethrough; and (c) means for fastening said at least one hoop to said plurality of spaced apart vertical supports to form a cylindrically-shaped frame dimensioned to fit within the refuse bag lining the cylindrical bin of said vacuum cleaner, said fastening means including a plurality of circumferentially spaced apertures in said at least one hoop, a plurality of apertures disposed along the length of each vertical support and associated with said pairs of vertical slots, and a plurality of fasteners adapted to be inserted into said apertures in said at least one hoop and said vertical supports to fasten them together.

2. The refuse bag frame as defined in claim 1, which comprises a plurality of vertically spaced-apart hoops interconnected by said plurality of spaced-apart, rigid, vertical supports.

3. The refuse bag frame as defined in claim 2, wherein each of said hoops is formed from a severable, flexible strip the length of which is cut to substantially the internal circumference of the cylindrical bin of said vacuum cleaner, the ends of said strips being connected to form hoops whose diameters are no greater than the internal diameter of the cylindrical bin.

4. The refuse bag frame as defined in claim 3, wherein said rigid, vertical supports are formed from severable, rigid, elongated strips which are cut to substantially the internal height of the cylindrical bin of said vacuum cleaner.

5. The refuse bag frame as defined in claim 1, wherein the material from which said hoops and vertical supports are formed is plastic.

6. The refuse bag frame as defined in claim 1, wherein the material from which said hoops and vertical supports are formed is metal.

7. The refuse bag frame as defined in claim 1, wherein said rigid, vertical supports are L-shaped and the base legs of the supports form radiuses substantially matching the radius of the cylindrical bin of the vacuum cleaner, said base legs of said supports being interconnected at their ends.

8. The refuse bag frame as defined in claim 7, wherein said base legs of said supports are interconnected by means of a disk-shaped plate to which said base legs are connected and from which said base legs radiate.

9. The refuse bag frame as defined in claim 8, wherein said at least one hoop is formed from a severable, flexible strip and said vertical supports are formed from severable, rigid L-shaped strips, the lengths of said strips being cut to accommodate the cylindrical bin of said vacuum cleaner.

10. The refuse bag frame as defined in claim 9, wherein said supports and said hoops are formed of plastic.

11. The refuse bag frame as defined in claim 9, wherein said supports and said hoops are formed of metal.

12. The refuse bag frame as defined in claim 1, wherein opposing pairs of said rigid, vertical supports are interconnected by a base leg which substantially matches the internal diameter of said cylindrical bin to form a U-shaped member, the base legs of said plurality of pairs of vertical supports being interconnected at their centers.

13. The refuse bag frame as defined in claim 12, wherein said at least one hoop is formed from a severable, flexible strip and said vertical supports are formed from severable, rigid V-shaped strips, the lengths of said strips being cut to accommodate the cylindrical bin of said vacuum cleaner.

14. The refuse bag frame as defined in claim 13, wherein the hoop and the vertical supports and interconnecting legs are formed of plastic.

15. The refuse bag frame as defined in claim 13, wherein the hoop and the vertical supports and interconnecting legs are formed of metal.

16. In combination, a vacuum cleaner comprising a cylindrically-shaped bin, a cover for said bin including a vacuum blower for creating a vacuum in said bin, a refuse bag lining said bin, the rim of the open end of said bag being clamped between the rim of said bin and said cover, a collection inlet disposed in the sidewall of said cylindrical bin, said refuse bag including an opening in the sidewall thereof through which said collection inlet passes into the interior of said refuse bag and means for sealing said opening upon the removal of said refuse bag from said vacuum cleaner, and a cylindrically-shaped refuse bag frame dimensioned to fit within said cylindrically-shaped bin to support said refuse bag in lining relationship with said cylindrical bin, said refuse bag frame comprising at least one hoop having a diameter no greater than the internal diameter of said cylindrical bin, a plurality of spaced apart, rigid, vertical supports, each support having a length no greater than the internal height of said cylindrical bin and having a channel-like cross sectional configuration with opposing flanges and pairs of aligned vertical slots, each slot of a pair being formed in a flange opposite the other slot and adapted to receive said hoop therethrough, and means for fastening said at least one hoop to said plurality of spaced apart vertical supports to form the cylindrically-shaped frame dimensioned to fit within the refuse bag lining the cylindrical bin of said vacuum cleaner, said fastening means including a plurality of circumferentially spaced apertures in said at least one hoop, a plurality of apertures disposed along the length of each vertical support and associated with said pairs of vertical slots, and a plurality of fasteners adapted to be inserted into said apertures in said at least one hoop and said vertical supports to fasten them together.

17. The combination of claim 16, which comprises a plurality of vertically spaced-apart hoops interconnected by said plurality of spaced-apart, rigid, vertical supports.

18. The combination of claim 16, wherein each of said hoops is formed from a severable, flexible strip the length of which is cut to substantially the internal circumference of the cylindrical bin of said vacuum cleaner, the ends of said strips being connected to form hoops whose diameters are no greater than the internal diameter of the cylindrical bin.

19. The combination of claim 16, wherein said rigid, vertical supports are formed from severable, rigid, elongated strips which are cut to substantially the internal height of the cylindrical bin of said vacuum cleaner.

20. In combination, a vacuum cleaner comprising a cylindrically-shaped bin, a cover for said bin including a vacuum blower for creating a vacuum in said bin and a collection inlet, a refuse bag lining said bin, the rim of the open end of said bag being clamped between the rim of said bin and said cover, and a cylindrically-shaped refuse bag frame dimensioned to fit within said cylindrically-shaped bin to support said refuse bag in lining relationship with said cylindrical bin, said refuse bag frame comprising at least one hoop having a diameter no greater than the internal diameter of said cylindrical bin, a plurality of spaced apart, rigid, vertical supports, each support having a lengyth no greater than the internal height of said cylindrical bin and having a channel-like cross-sectional configuration with opposing flanges and pairs of aligned vertical slots, each slot of a pair being formed in a flange opposite the other slot and adapted to receive said hoop therethrough, and means for fastening said at least one hoop to said plurality of spaced apart vertical supports to form the cylindrically-shaped frame dimensioned to fit within the refuse bag lining the cylindrical bin of said vacuum cleaner, said fastening means including a plurality of circumferentially spaced apertures in said at least one hoop, a plurality of apertures disposed along the length of each vertical support and associated with said pairs of vertical slots, and a plurality of fasteners adapted to be inserted into said apertures in said at least one hoop and said vertical supports to fasten them together.

21. The combination of claim 20, which comprises a plurality of vertically spaced-apart hoops interconnected by said plurality of spaced-apart, rigid, vertical supports.

* * * * *